US005180401A

United States Patent [19]

Owenby et al.

[11] Patent Number: 5,180,401

[45] Date of Patent: Jan. 19, 1993

[54] PRINTED WOVEN BLANKET

[75] Inventors: Daniel B. Owenby, Swannanoa; Gene Quesinberry, Black Mountain, both of N.C.

[73] Assignee: Beacon Manufacturing Company, Swannanoa, N.C.

[21] Appl. No.: 768,167

[22] Filed: Sep. 30, 1991

[51] Int. Cl.[5] ..... B32B 9/00

[52] U.S. Cl. ..... 8/478; 8/474; 8/480; 8/481; 8/482; 8/483; 8/484; 8/485; 8/486; 8/487

[58] Field of Search ..... 8/478, 487, 479, 480, 8/481, 482, 484, 485, 486, 487

[56] References Cited

U.S. PATENT DOCUMENTS

| | | | |
|---|---|---|---|
| 646,379 | 3/1900 | Tagliani | 8/478 |
| 1,854,321 | 12/1928 | Webster | 8/478 |
| 4,108,595 | 8/1978 | Pappas | 8/482 |

*Primary Examiner*—Patrick J. Ryan
*Assistant Examiner*—Abraham Bahta
*Attorney, Agent, or Firm*—Carter & Schneidler

[57] ABSTRACT

A printed woven blanket is provided which is printed on only one side but has the appearance of having been printed on both sides. A cationic dye is applied to one side of the blanket utilizing a roller which forces the dye into the fabric forming a printed pattern. The printed blanket is dried and then steamed to set the dye. The blanket is napped which further enhances the appearance of the side which is not printed.

7 Claims, 2 Drawing Sheets

PRINTED WOVEN BLANKET

BACKGROUND OF THE INVENTION

This invention relates to blankets. More particularly it relates to printed woven blankets.

Various types of blankets are sold having designs or patterns on one or both sides. These blankets range in quality from low cost nonwoven blankets, which are printed on one or both sides, to high cost Jacquard woven blankets which are made with individually dyed yarns which are woven together utilizing sophisticated numerical controls to form patterns or designs which are equally visible on both sides of the blanket. Because of the fact that the yarn in each color group must be independently dyed, because the manufacturer must utilize expensive numerically controlled Jacquard looms in order to complete the manufacture, and because of the labor involved in setup and the operation of the Jacquard looms, Jacquard woven blankets are very expensive, often costing the consumer more than $70.

Nonwoven blankets are very inexpensive, often costing the consumer less than $5. However, nonwoven blankets tend to be stiff and do not have the feel or hand of a woven blanket.

Standard woven blankets generally cost the consumer slightly more than $15. In order to produce a woven blanket with colorful patterns or designs, which has a good hand, without using the expensive Jacquard weaving process, standard woven blankets have been subjected to dyes, i.e. printing, after weaving. However unless the blanket is printed on both sides, i.e. the blanket is run through two printing and finishing cycles involving numerous steps, it has been found that, while the printed side of the blanket will show vivid colors and definition, the unprinted side will show only a fraction of the color and definition of the printed side.

Printed woven blankets have been manufactured by applying dye to one side of the blanket through a print screen utilizing an elongated blade or squeegee like device which forms a wave of the dye inside the print screen. The dye flows through the screen onto the surface of the blanket fabric. Penetration into the fabric is not substantial. Pigment, fiber reactive, and cationic dyes have been used depending on the type of fabric, i.e. acrylic, cotton, etc. After the dye is applied, the blankets are subjected to various processes including drying, steaming, scouring and napping. While the printed side of the blanket exhibited strong coloration and definition, the unprinted side did not exhibit nearly as strong a coloration and furthermore the designs on the unprinted side lacked definition. Thus the purchaser could readily distinguish one side of the blanket from the other. Heretofore blanket manufacturers have not been able to produce a printed blanket which has the appearance of a Jacquard woven blanket.

OBJECTS OF THE INVENTION

It is therefore one object of this invention to provide an improved printed woven blanket.

It is another object to provide an improved printed woven blanket which is printed on only one side but gives the appearance of having been printed on both sides.

It is another object to provide a printed woven blanket which is inexpensive to manufacture but has the appearance of a much more expensive Jacquard manufactured blanket.

It is another object of the invention to provide an improved method for manufacturing printed woven blankets.

SUMMARY OF THE INVENTION

In accordance with one form of this invention, there is provided a woven blanket including a fabric constructed of woven yarn. The fabric has a first side and a second side with at least a portion of the first side having been printed with a dye. A visible pattern is formed on the first side and the second side as a result of the first side having been printed, with the visible characteristics of the pattern on the second side being substantially the same in intensity and resolution as the pattern on the first side. It is preferred that the blanket not be printed on the second side.

Preferably the blanket is made of an acrylic yarn and the dye utilized is a cationic dye.

In accordance with another form of this invention, there is provided a method for producing the above-described printed woven blanket. Only one side of a woven blanket is printed with a dye. The printing is preferably accomplished by applying the dye through a print screen utilizing a roller which places downward pressure on the dye which forces the dye into the blanket yarn. Preferably the dye is completely dried after printing. Moisture, preferably steam, is then applied to the printed blanket to set the dye. At least the one side of the blanket is then napped.

Preferably the pressure applied on the roller may be varied by the operator so that the amount of dye put into the blanket and thus the intensity of color may be controlled. It is also preferred that the pressure be controlled by the use of magnetic force on the roller. By using the above-described method it is believed that the dye will penetrate at least to a depth of 40% into the yarn.

BRIEF DESCRIPTION OF THE DRAWINGS

The subject matter which is regarded as the invention is set forth in the appended claims. The invention itself however together with further objects and advantages thereof may be better understood in reference to the accompanying drawings in which:

DESCRIPTION OF THE PREFERRED EMBODIMENT

Figure 1:
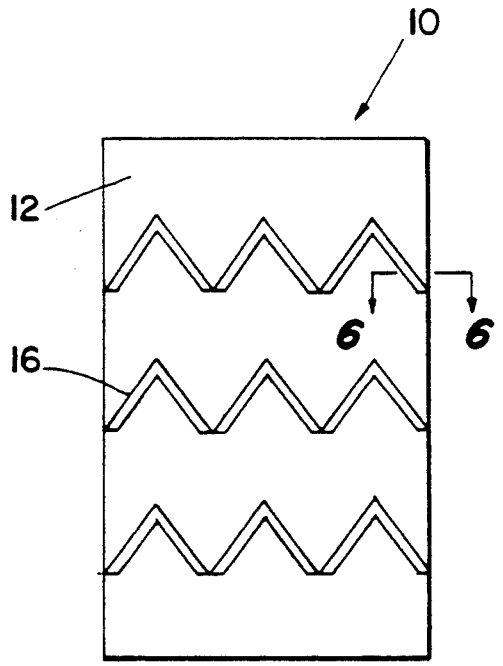
FIG. 1 is a plan view of one side of the blanket of the subject invention.
Figure 2:
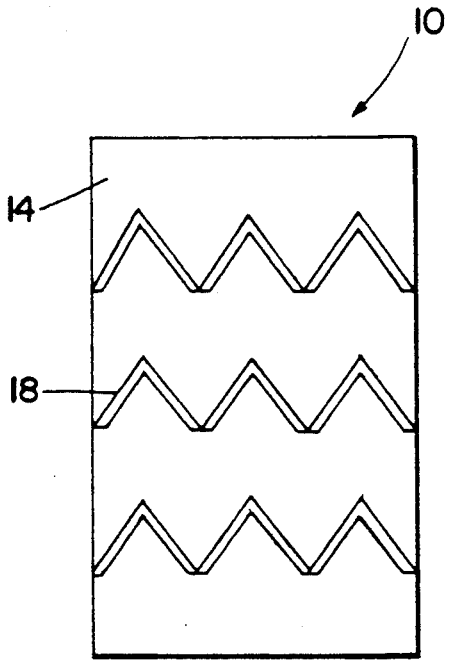
FIG. 2 is a plan view of the other side of the blanket of FIG. 1.
Figure 3:
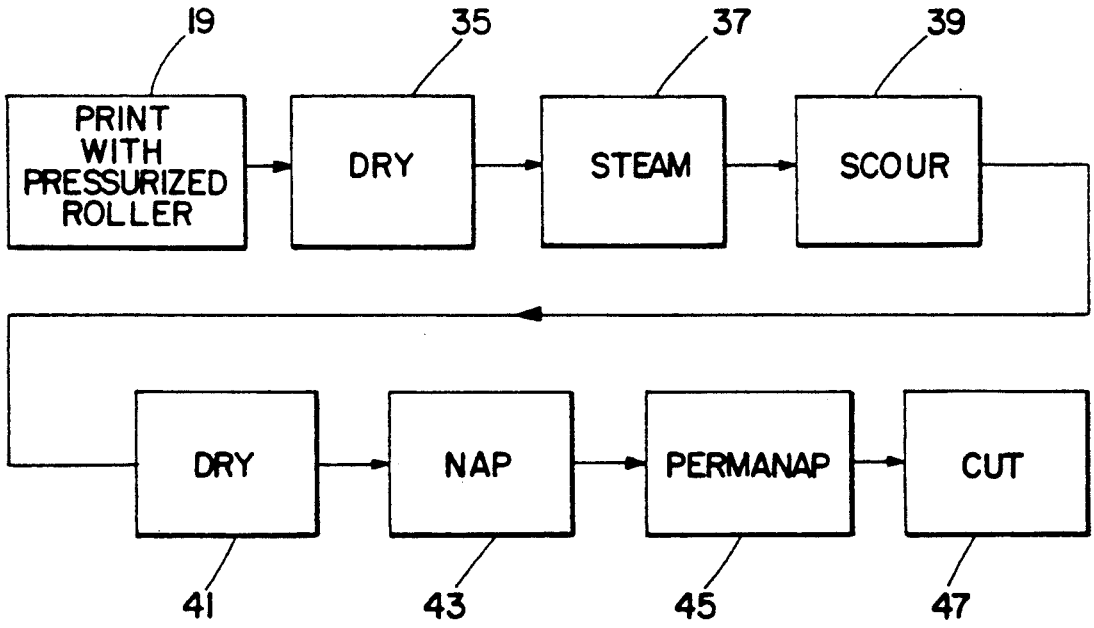
FIG. 3 is a block diagram illustrating the steps in the process utilized to manufacture the blanket shown in FIGS. 1 and 2 in accordance with the subject invention.

Referring now more particularly to FIGS. 1 through 6, there is a provided woven blanket 10 having two sides, namely side 12 as shown in FIG. 1 and side 14 as shown in FIG. 2. Both sides of blanket 10 exhibit printed patterns 16 and 18, although only one side, namely side 12, has been printed by direct exposure to a dye. However, by utilizing the process described below, one cannot visually detect a substantial difference in color intensity or resolution between the dyed side 12 and the undyed side 14. The patterns 16 and 18 are simplified and are for illustration purposes only. Preferably the entire side 12 is exposed to several dyes of various colors.

Figure 4:
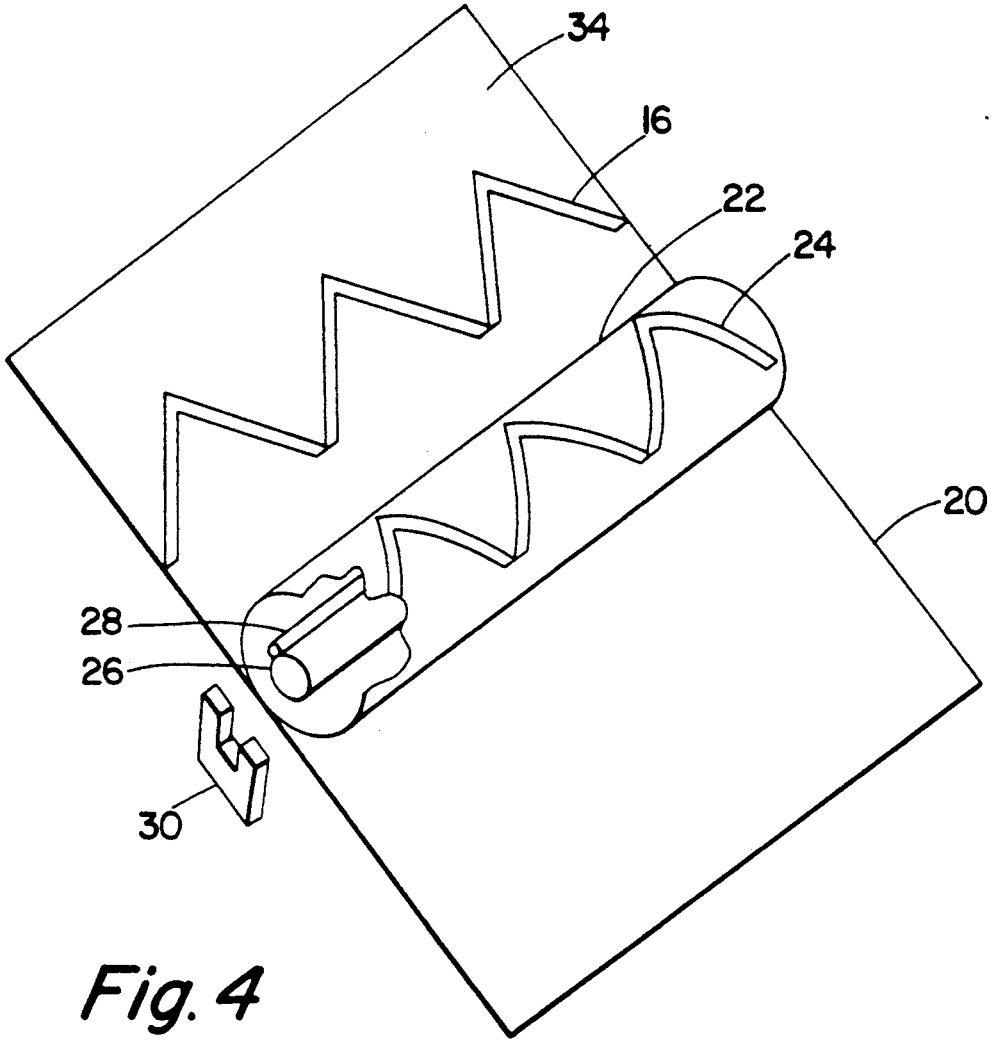
FIG. 4 is a pictorial view illustrating a portion of the printer with pressurized roller of FIG. 3 being utilized to print the side of the blanket shown in FIG. 1.
Figure 5:
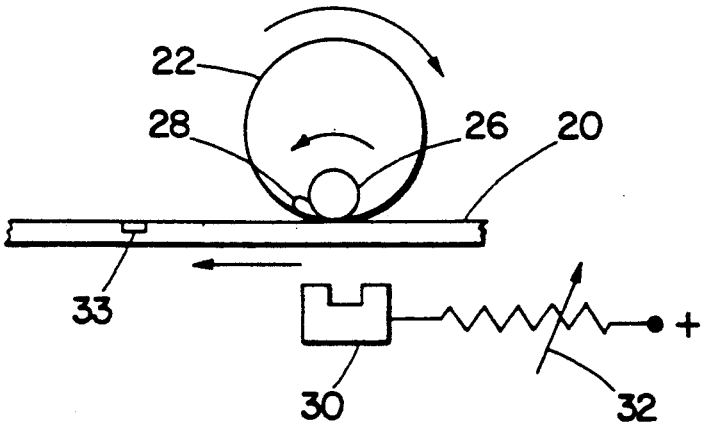
FIG. 5 is a side elevational view showing a portion of the apparatus of FIG. 4.
Figure 6:
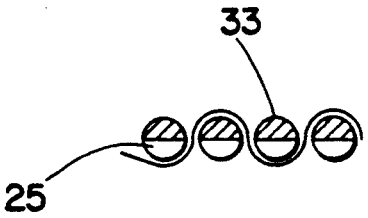
FIG. 6 is a sectional view of the blanket of FIG. 1 taken through section lines 6–6.

Referring now more particularly to FIGS. 3 through 6, there is a provided a method for the manufacture of the blanket shown in FIGS. 1 and 2. In the first step of the process, illustrated as block 19 in FIG. 3, the unprinted woven blanket fabric 20 which is preferably made of white acrylic yarn is printed with a dye, which preferably is a cationic dye. The preferred printing apparatus is an MBK printer Model No. SDM2020 which is commercially available from MBK Maschinenbau Krefersfelden GmbH. The printer includes a plurality of rotatable cylindrical print screens, one of which is illustrated in FIG. 4 as print screen 22. Print screen 22 includes template openings 24 which, together with dye 28, form the printed pattern 16 on the blanket. The printer normally includes additional cylindrical print screens with various patterns to be used with different colored dyes to print different colored patterns on the blanket. However for simplicity's sake the additional screens are not shown.

Inside the cylindrical print screen 22 a rotating floating cylindrical roller 26 is provided. The roller is utilized to force dye 28, which is received inside the screen 22, through the template openings 24, and into the fabric 20. Roller 26 applies a downward pressure on dye 28, the print screen 22 and thus the fabric. The downward pressure is caused by magnet 30 which interacts with the roller. Preferably the force of magnet 30 is made variable by means of a device such as variable resistor 32 so that the amount of pressure of the roller and thus the printed color intensity is controllable. By utilizing this cylindrical roller 28 with downward pressure, a substantial depth of penetration of the dye into the fabric will result as indicated by dye penetration 33. This dye penetration 33 is also illustrated in referenced to FIG. 6 which shows a cross section of the weft yarns 25 of finished blanket 10. It is believed that a dye penetration into the yarns 25 of greater than 40% may be achieved for normal denier blanket yarns. The roller should be made out of metal such as iron or steel which is attracted by and thus controlled by magnet 30.

The freshly printed fabric 34, which will eventually form blanket 10 when cut, then moves to the dryer stage 35. It is preferred that the dryer completely dries the dye so that it will not cause spotting of the fabric 34 when that fabric is moved to the next stage in the process. A preferred dryer is a Tubular Jet Aztec dryer commercially available from the Aztec Machinery Company. The Aztec dryer provides for multiple passes of the blanket fabric through the dryer so as to ensure complete drying of the dye. The dried fabric 34 is then run through a steamer 37 which is used to "set the dye," that is, the steam causes the cationic dye to penetrate into the acrylic fibers in the yarn of the fabric. An acceptable steamer is a Continuous Ager steamer commercially available from the Morrison Company. The fabric is then scoured as indicated by step 39 to remove unwanted chemicals as well as excess dye. An acceptable scourer is an Open Width scourer commercially available from the Morrison Company. The fabric is then placed in another dryer 41. An acceptable dryer for this final drying step is an Artos Tentu Flow Through dryer, commercially available from the Artos Company. The fabric 34 is then pile napped both on side 12 and side 14. An acceptable pile napper is a Woonsocket Thirty-Six Roll, Double Acting napper, Model No. 1036 commercially available from United Textile Machinery Corp. The fabric then undergoes felting on a single acting napper. An acceptable napper is a Franz-Muller single acting napper commercially available from BASF Corporation. The construction of dryers, steamers, scourers and nappers is well known to those skilled in the blanket art and therefore detailed descriptions are not necessary.

Nappers are primarily utilized in the blanket industry to raise the fibers thereby imparting a soft hand to the blanket. However, it was found that since the dye obtained such a deep penetration 33 into the fabric by the printing step and such penetration was set by the steam step, the napper will also "pull through" the image which has been printed on side 12 of the blanket to side 14 to the extent that an observer cannot tell any subtracted difference in the intensity and sharpness of the images on one side 12 and side 14 of the blanket. That is, blanket 10 appears to have been printed both on side 12 and 14. Furthermore it has been found that better results are achieved when more napping pressure is used on the dyed side 12 than the undyed side 14. The napping step also softens the appearance of the patterns 16 and 18 on both sides of the blanket so that the images are not too sharp in addition to imparting a softer hand to the blanket.

After the napping step, the fabric 34 is sprayed with ethylene carbonate (Permanap) and a softener as illustrated by step 45. The fabric is then cut to the desired size of the blanket which normally is 80"×90", and the blanket is ready to be packaged and sold.

The preferred dyes used to print the blankets are referred to as cationic dyes. Cationic dyes were chosen because of their ability to penetrate into certain synthetic fibers, such as acrylic, and because they more readily penetrate into synthetic fibers than pigments. Acceptable cationic dyes are commercially available from the Ciba Giegy Company. For blankets made of cotton, fiber reactive dyes are preferred.

A blanket, which was manufactured as set forth above, has been tested, along with a prior art blanket, utilizing an ACS optical tester. Several measurements of reflected light were taken at corresponding pattern positions on each side. Both blankets were made with acrylic fibers. Each was dyed on one side only using cationic dyes. The prior art blanket was made utilizing printers having a squeegee type dye applicator. The table set forth below illustrates the result.

PERCENT REDUCTION OF REFLECTED LIGHT FROM PRINTED SIDE TO UNPRINTED SIDE

| | Prior Art Acrylic Blanket | Acrylic Blanket of the Subject Invention |
|---|---|---|
| Position A | 27.44% | 13.4% |
| Position B | 26.48% | 8.97% |
| Position C | 33.84% | 10.36% |

There was much less reduction in reflected light for the blanket of the subject invention than the prior art blanket.

Thus a printed woven blanket is provided which appears to have been printed on both sides while in reality it was printed only on one side, and which has the look and feel of a more expensive Jacquard produced blanket.

From the foregoing description of the preferred embodiment of the invention it will be apparent that many modifications may be made therein without departing from the true spirit and scope of the invention.

We claim:

1. A woven blanket comprising:

a fabric constructed of woven yarn; said fabric having a first side and a second side; said fabric having been printed with a dye on at least a portion of said first side; said fabric not printed on said second side; a visible pattern being formed on said first side and said second side; the visible characteristics of said pattern on said second side being substantially the same in intensity and resolution as the pattern on said first side; said second side exhibiting substantially the same color and pattern as said first side.

2. A blanket as set forth in claim 1 wherein said yarn is made from synthetic fibers.

3. A blanket as set forth in claim 2 when said yarn is acrylic.

4. A blanket as set forth in claim 1 wherein said dye is a cationic dye.

5. A blanket as set forth in claim 1 wherein the visible pattern on said first and second sides each being out of focus thereby providing soft images.

6. A blanket as set forth in claim 1 wherein the dye penetration into said yarn is greater than 40%.

7. A blanket as set forth in claim 1 wherein the percent reduction in reflected light from said first side to said second side is less than 13.4%.

* * * * *